United States Patent [19]

Gregory

[11] Patent Number: 4,501,098

[45] Date of Patent: Feb. 26, 1985

[54] HYBRID HOME CONSTRUCTION TECHNIQUE

[75] Inventor: James H. Gregory, Irvine, Calif.

[73] Assignee: Heritage Homes, Inc., Ridgecrest, Calif.

[21] Appl. No.: 399,906

[22] Filed: Jul. 19, 1982

[51] Int. Cl.[3] ..... E04H 1/00

[52] U.S. Cl. ..... 52/79.1; 52/79.9; 52/143; 52/745

[58] Field of Search ..... 52/79.1, 79.9, 745, 52/169.3, 143

[56] References Cited

U.S. PATENT DOCUMENTS

| | | | |
|---|---|---|---|
| 2,706,313 | 4/1955 | Radman | 52/79.9 |
| 2,712,863 | 7/1955 | Busch | 52/79.1 |
| 2,990,588 | 7/1961 | McKinley | 52/143 |
| 3,492,767 | 2/1970 | Pincus | 52/745 X |
| 3,862,534 | 1/1975 | Coletti | 52/745 |
| 4,078,343 | 3/1978 | Moore, Jr. | 52/79.1 |
| 4,258,512 | 3/1981 | Delk et al. | 52/79.9 |
| 4,327,529 | 5/1982 | Bigelow, Jr. et al. | 52/79.1 |

*Primary Examiner*—Carl D. Friedman

*Attorney, Agent, or Firm*—Knobbe, Martens, Olson & Bear

[57] ABSTRACT

A method of constructing a house comprising constructing modular structures for a first level of the house away from the building site in a factory. The modular structures are constructed according to Uniform Building Code standards and provide substantially all standard dimension portions of the first level of the house. The modular structures are positioned on the foundation, and the non-standard portions of the first level of the house, and the second level if there is one, are then constructed to provide those portions of the house possessing creative architectural design. Finally, a roof structure is constructed over the house and exterior finishing is performed.

3 Claims, 13 Drawing Figures

10
12
14
16
20
21
22
23
24
26
28
30
32
34
36
40
42
44
46
48

10
12
20
34
42
44
46
48
52
53
54
56

Fig. 3
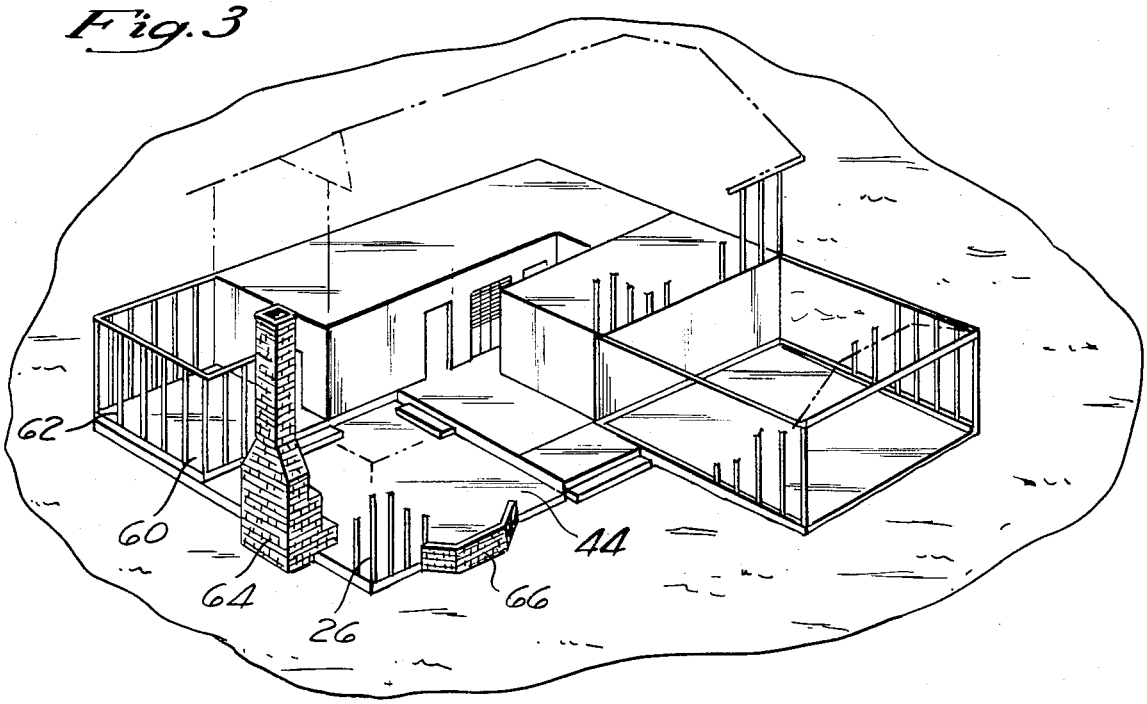
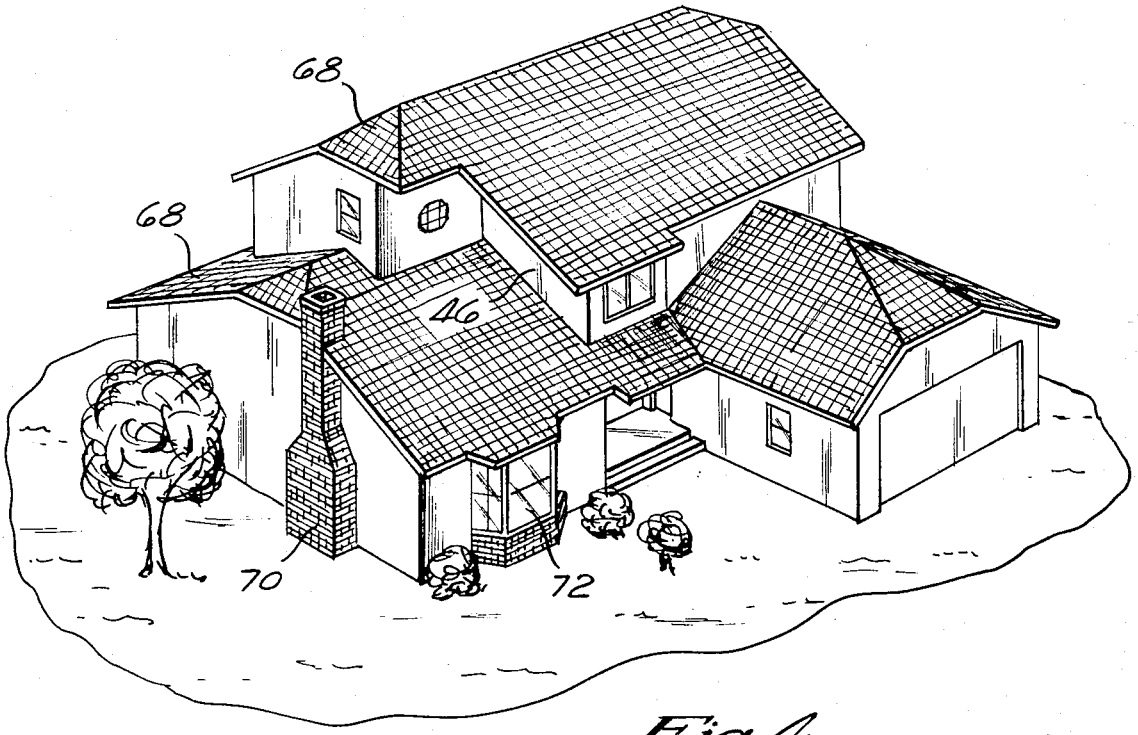
Fig. 4

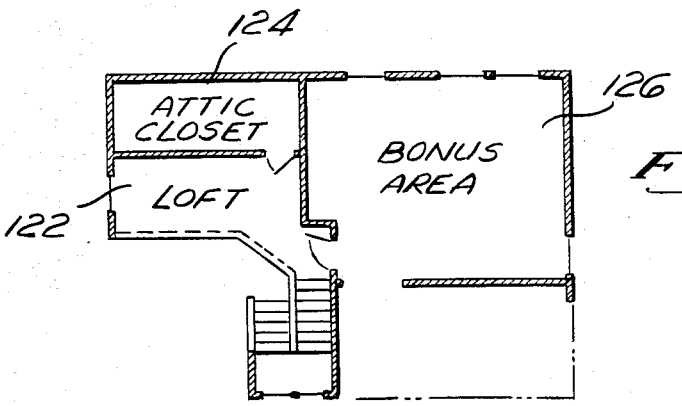
Fig. 8
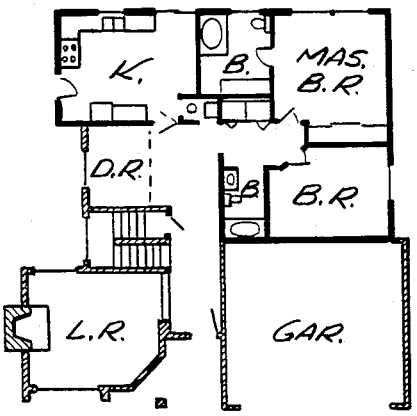
Fig. 9
Fig. 10
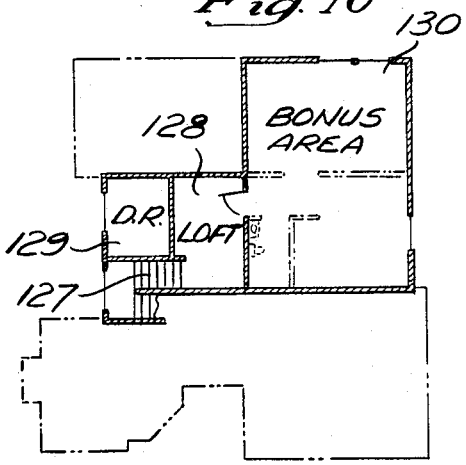
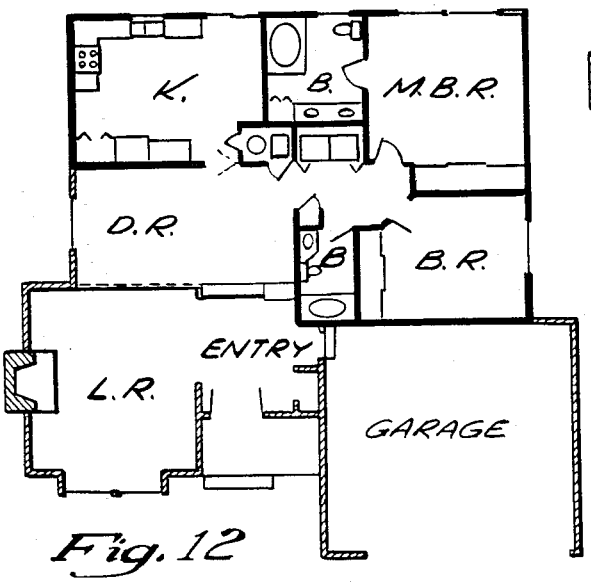
Fig. 12
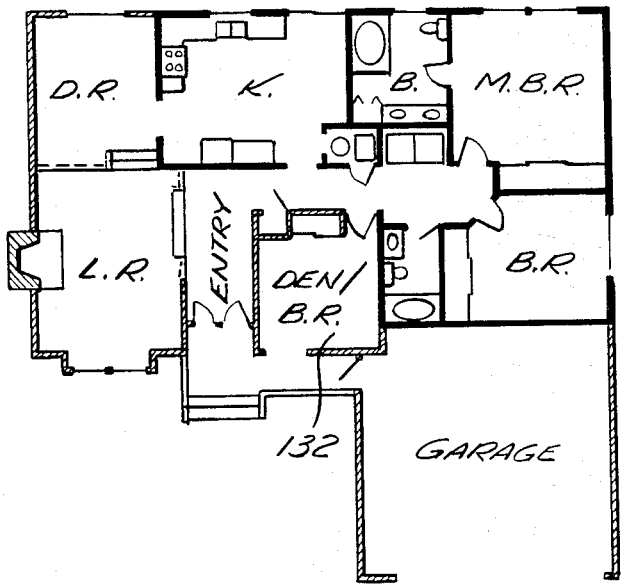
Fig. 11

HYBRID HOME CONSTRUCTION TECHNIQUE

BACKGROUND OF THE INVENTION

Conventional single family homes are most often constructed on the location of the building site from individual pieces of lumber by trade workmen. This method of construction allows great flexibility in designing and constructing a house structure. Since each particular section of a house is part-by-part constructed and assembled with the whole of its structure, custom house constructions are easily accomplished. Unlimited possibilities exist using this type of construction for achieving enlarged and open spaces in the interior living areas of the house, such as raised or vaulted ceilings, dormers, bi-level or sunken floor surfaces, split level balconies, etc.

It is the enlarged space living areas of a house having non-standard three-dimensional form which create the character and ambience one recognizes and appreciates and which brings value to the home. These characteristics are an important factor, not only in providing a home which engenders feelings of comfort and attractiveness for the inhabitant, but also provides a house which is much more desirable and capable of sale in a competitive housing market. The discriminating home buyer has come to expect features of elegance and originality in a home created by custom design of the enlarged living space areas. Providing these features of expression and individuality in a house greatly aids in convincing a home buyer to purchase, while achieving better profits for the home builder.

Modern times have found increased economic pressure on the builder to reduce the costs of construction of a house, while maintaining the character and ambience desired by the home buyer. Greatly increased costs of labor and materials, combined with the large amount of time necessary for, and inefficiencies inherent in, constructing a house at a building site, have drastically increased housing prices to a level which many prospective buyers cannot afford. In response, the building industry has attempted many methods of prefabrication, including constructing entire houses or portions of houses at a remote manufacturing facility. The preconstructed units are shipped to the building location and finally assembled in building block fashion. Off-site prefabrication methods have taken advantage of factory assembly line techniques to reduce labor costs of construction. Limiting on-site activities to assembly of preconstructed units, installation of mechanical and electrical systems and finishing work, similarly reduce labor costs normally incurred by reducing scheduling conflicts which extend construction time. These efficiency and cost-saving techniques allow for construction of an increased number of houses per week. Additionally, material damage and loss incurred through storage of materials at a building site are substantially reduced.

The advent of prefabricated construction methods, however, has in the past resulted in a less desirable home product. The artisans of building construction and of factory technology have found it necessary to compromise many of the afore-mentioned desirable features of a house which can be provided through on-site construction. Of the first and foremost causes, is the nearly universal approach used by prefabricated housing manufacturers of providing house structures which are identically shaped, and box-like in configuration. It has been understood that these box-like configurations are necessary in order to take advantage of mass production techniques in the factory, and efficiently shipping these preconstructed units in observance of highway transportation size limitations. Many designs of prefabricated units have substantially integrated the known structures and construction techniques of the mobile home industry, which have been designed in view of unit construction of the mobile home in a factory and in view of size limitations necessary for transportation of a completed mobile home on the highway.

However, mobile home construction is typically performed according to specifications and standards specifically developed in the mobile home industry. Preconstructed units manufactured according to mobile home standards and specifications present problems due to construction differing with the standard on-site constructed house which is typically constructed according to a Uniform Building Code (UBC), when adapted within the house structure. The differing types of construction, and sometimes reduced quality, have been found to be less than desirable in the home marketplace. Differing constructions can also cause complicated certification and approval proceedings, and inspections by a local building inspector at the construction site. Further, the box-like structures, typical of mobile home construction, have resulted in houses having identical or very similar rectangular constructions when assembled. These near identically shaped houses provide very little identity or uniqueness for a home, other than the color in which it is painted, and provides little appeal to a discriminating home purchaser.

Moreover, constructions using mobile home-type prefabricated structures as a central core are prohibited in some localities. Often they require specially configured or raised foundations so that the chasis and wheel structure may be accommodated.

A multitude of similarly shaped houses constructed in a home tract presents an unattractive and unappealing scene. The affect has been the formation of an image of undesirability in the minds of the home buying public. Because of the decreased desirability of these preconstructed homes, they will not bear a price comparable with a similar sized house constructed on-site. Further, they present increased difficulty in eliciting a sale. The reduced price leaves a builder in a position of obtaining lower profits, thereby reducing his incentive to provide lower priced homes in the marketplace.

Exemplary of prior art teachings incorporating prefabricated mobile home-type structures into a modular construction is the construction method described by Pincus, U.S. Pat. No. 3,492,676. Pincus shows a prefabricated mobile home-type construction comprising outside structural walls and a floor attached to a steel I-beam chassis on which the unit is transported. The structure, including a chassis, is set upon a foundation at the building site after which the axle, wheels and trailer hitch are removed. A house is constructed around the prefabricated unit which is limited in configuration because it must specifically conform to the central modular portion, usually having bedrooms on one side and a living area on the other side of the unit, as is shown. The resultant structure is most often box-shaped in configuration without demension or enlarged, elegant living spaces, therefore, having little visual attractiveness.

Similarly, Coletti, U.S. Pat. No. 3,862,534 teaches a method of building construction in which a central opensided building module having a rectangular configuration is centrally positioned on a foundation, with preconstructed structure assembled on both sides of the building module to complete the house structure. The completed structure is again box-like in configuration with little individual identity.

SUMMARY OF THE INVENTION

The present invention is a method for constructing low density housing which provides a house having a uniform conventional structure typical of an on-site built house. Construction of a house by this method is economically accomplished through manufacture of a portion of the house structure off-site, in a factory, and custom construction of remaining portions of the house structure on-site. A completed home which is constructed using this method may include enlarged space living areas, having character, ambience and originality desired by the discriminating home buyer. These features of attractiveness combine with a reduced cost to yield a home product which is highly marketable and which provides acceptable profit for the builder.

This method for constructing a house comprises building modular portions of the house structure off-site in a factory, transporting the modular sections to the building site, and positioning them on a foundation to substantially form the first level of the house. The modular sections are designed to provide those portions of the house which are non-expressive and which have standard elovations from the floor surface to ceiling. These modular portions of the house structure can be advantageously constructed through assembly line technique in a factory of a size which meets highway size regulations, to obtain cost savings without sacrificing elements of character and originality in the completed house product. The modular house portions generally comprise the utility areas, which include the kitchen and bathrooms, and the slumber areas, which include most of the ordinary bedroom space, in addition to substantially all of the mechanical and electrical systems required for the house. The modular portions are constructed according to Uniform Building Code (UBC) having a typical joist constructed floor system, stud framed walls, and rafter overhead ceiling support structure, all constructed to standard dimensions and from standard materials.

After the modular portions are installed, the method provides for the remaining house structure to be custom constructed on-site to create the enlarged space living areas of the home defining the volumetric room shapes which attract one's attention and provide visual identity to the home. The enlarged space living areas include those portions of a home having non-standard elevational forms which express architectural design to inspire sensations of character, ambience and originality desired by the buyer; exemplary of the enlarged space living areas are a living room or dining room with a cathedral wood beamed ceiling or sunken floor surface, or an entrance hall of capacious dimension, and possibly a master bedroom. Custom construction of these enlarged space areas further allows addition therein of decorative fixtures which increase value and attractiveness in a home, such as a fireplace, a bay window, an open supported stairway, or exposed beams supporting the ceiling. These custom constructed portions are more economically built on-site than in a factory, and easily integrated into the modular structure of UBC construction, to create a home structure of uniform conventional construction when completed.

The uniform conventional construction increases desirability and value of the house. A completed house constructed with this method presents a normal outward appearance eliminating a box-like configuration typical of prior prefabricated houses. Custom construction on-site allows tiered roof line shapes in varying depth facial aspect for attractive outward appearance while allowing variations to be manifest by adjacent houses to maintain interesting perspective in a housing tract.

This method of construction further provides modular portions of a house structure which are designed for adaption to at least 21 varying floor plans for a home, wherein all elevation and interior changes are accomplished through on-site construction phases of this house construction method. This allows a builder to take advantage of cost savings and scheduling economy inherent in volume factory construction, while providing many different home designs to increased marketability, value, and acceptance of this home product.

Since the factory-built modular portion of the house structure is constructed according to a Uniform Building Code (UBC) and includes many of the labor intensive sections of a house structure which must be approved by an inspector, advantages are obtained through the ease of acceptance of a home plan design using this method of construction by local inspection agencies. Certification can be obtained for the modular portions of the house structure from a state inspection board, which assures acceptance of these modular portions in local jurisdictions because the modular portions are identically constructed by the factory according to UBC. There is also a high degree of surety that a UBC constructed modular portion will be accepted for certification in any state. Savings and cost, calculation time, and scheduling time for inspection are great with this method of construction, aiding and reducing the price of the finished product. Further, inspection problems which occur with integration of mobile home-type construction within a house structure are eliminated.

The factory built modular portions of the first level house structure are constructed with overhead rafter structure designed to provide a joist floor system for a second story, which may be constructed for the house at the building site. This overhead structure design for the modular portions increases their adaptability into two story house design, to further increase the builder's portfolio home products. The modular sections are constructed to include major mechanical and electrical systems required for the second story of the house so that the second story construction performed on-site is simple and requires little specialized trade work and few inspections.

After completion of the main house structure, this method of construction includes final steps of constructing a roof system for the house, completing the exterior surfaces of the house, and completing interior finishing work of the on-site built portions of the house. An attached garage may be included preceding these final steps, if desired by the builder to further increase the value of the home.

The factory built modular portions of the house structure are completely finished throughout their interior so that only decorating work is necessary for completion of this portion of the house, when they are installed.

DESCRIPTION OF THE DRAWINGS

FIGS. 1 through 5 are perspective schematic views illustrating the manner in which a house is constructed in accordance with the method of the invention, with FIG. 1 showing the foundation and a pair of housing modules that have been built in a factory and transported to the foundation site.

FIG. 2 shows the manner by which a module is positioned on the foundation.

FIG. 3 shows the manner in which the non-standard components of the house are constructed adjacent to the modules, and also shows in phantom lines a second story over the modules.

FIG. 4 shows the completed exterior of the house.

FIG. 5 illustrates some of the completed interior portions of the house.

FIG. 8 is a floor plan for a second story of the house of FIGS. 1 through 5.

FIG. 9 shows another floor plan utilizing modules of the invention.

FIG. 10 illustrates a floor plan for a second floor of the plan shown in FIG. 9.

FIGS. 11, 12 and 13 show additional floor plans utilizing the modules of the invention.

DETAILED DESCRIPTION OF THE INVENTION

Figure 1:
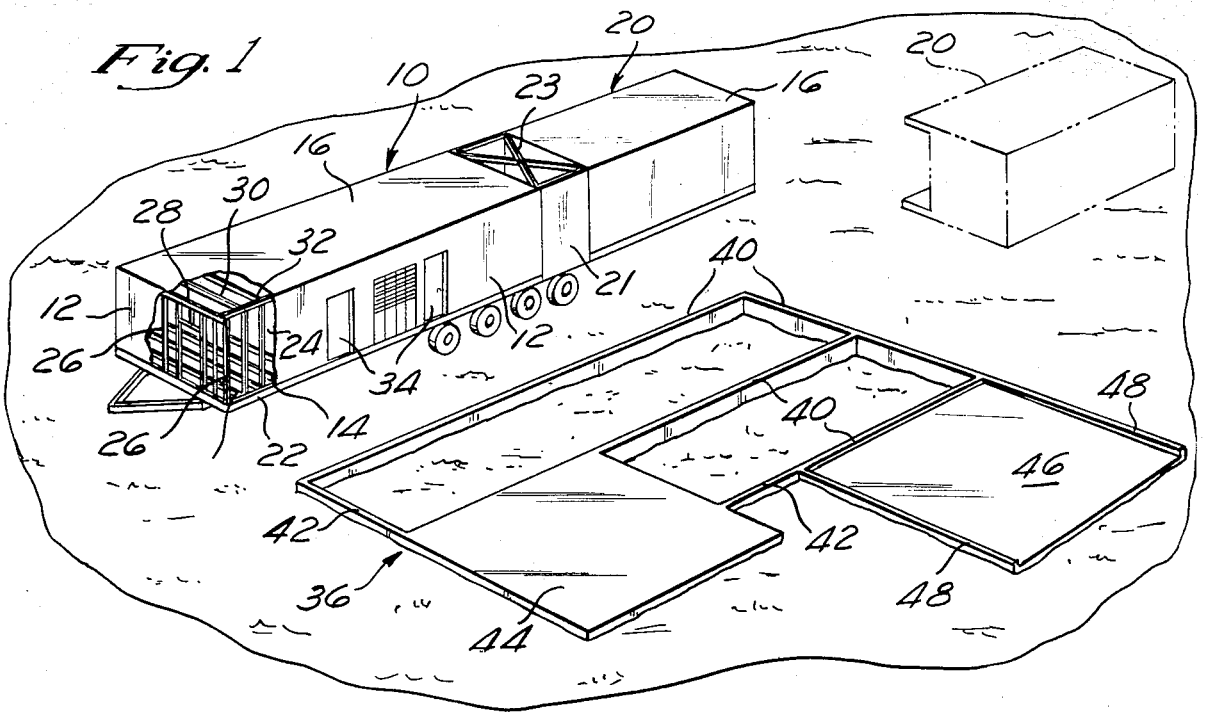

The method presented for construction of a house is shown with reference to FIGS. 1 through 5. The preferred method comprises construction of modular structures, such as 10 and 20, in a factory away from the building site, as a first step. The modular structures are constructed by assembly line method to provide a completed portion of the first story of the house when combined. Each modular structure is constructed according to a Uniform Building Code (UBC) for houses. The Uniform Building Code for houses requires conventional construction identical to construction typically performed on-site at a building location. The modular structures constructed according to UBC standards can, therefore, completely integrate within the total house structure to provide a conventionally constructed home upon completion. This is an important feature to obtain value in a home.

Each modular structure has four walls 12, a floor structure 14 and an overhead support structure 16 conventionally constructed to form the standard dimension rooms of a first level of the house. As used herein, standard dimension rooms shall mean those rooms which have a generally square or rectangular shape, and have standard height, 8 foot, floor to ceiling elevations, as defined in the Uniform Building Code. Standard or conventional construction shall mean joist and stud framed walls, floor and ceiling structure, having support members positioned on 16-inch center distances, as required by the Uniform Building Code. The support members, such as studs or joist, are typically made of wood, however, in some instances, steel or other materials may be used.

Thus, each modular structure includes a joist constructed floor system 14 which includes a plurality of spaced and parallel joist members 20 extending between side support beams and plate members 22 defining the lower side edge of the modular structure. A planar shaped material 24, such as plywood, is fastened to cover the joist members 20 to provide a floor surface. Stud framed walls 12 having a plurality of vertical spaced and parallel studs 26 which extend between a frame structure 28 to form the side walls 12 for each modular section. The side walls 12 rest upon the floor system 14 and are connected by conventional attachment techniques to the side support beams 22 along the periphery of the joist floor system.

An overhead support structure 16 having a plurality of joists 30 positioned in parallel and spaced relation extending between the uppermost portions 32 of the stud framed walls 12 provides an overhead structure to which a ceiling (not shown) is attached. The overhead structure 16 is constructed according to UBC to provide a joist constructed floor system for a second story of the house should a second story be desired.

Each module includes doors 34 which are installed in the factory. Also, all mechanical systems and electrical systems, and built-in appliances are installed in the factory. The modules are provided with interconnections for the mechanical and electrical systems so they may be easily united with one another. Further, attachment points are provided for extension of the mechanical and electrical systems into other portions of the house, which will be built after the modular structuree are assembled at the building site.

Preferably, the modules 10 and 20 are constructed as a single unit as shown in solid lines in FIG. 1. That is, the horizontal side beams 22 at the base of the side walls extend across a 3 or 4 foot work space 19 between the modules, and the beams at the top of the side walls similarly span the space between the two. The primary advantage of this is that the two modules may be shipped as a single unit on one trailer 50. Preferably, the modules 10 and 20 are constructed so that their combined length plus the length of the space 19 is no more than 70 feet, so that the modules may be borne by a single trailer within the limitations for transport across the highway. This minimizes transportation expense, of course, for larger houses, the modules may be transported to the building site on separate trailers. Another advantage of forming the modules as one unit is that the work can proceed easily in assembly line fashion, with the flooring and framing for both units being assembled at the same time. Similarly, the other constructional phases may be efficiently performed for both modules at the same time. The space 19 between the modules is provided to facilitate this work. When the combined unit is being readied for shipment, shear panels 21 are secured to the beams to enclose the sides of the workspace 19 and provide needed strength during shipment of the unit. Similarly, cross braces 23 are employed to strengthen the ceiling area between the two modules.

In a preferred embodiment, one of the modules 10 is longer than the other module 20, to provide varied and numerous floor plans for the first level of the house, in which the modular structures may be integrated. In the arrangement shown, the module 10 is almost twice as long as the other module.

While the modules are being constructed in the factory, a foundation 36 is constructed at the building site. The foundation comprises a matrix of footings 38, which provide support surfaces 40 upon which the modules 10 and 20 may be positioned, and adjacent support surfaces 42 upon which other portions of the house may be constructed after the modules are placed in position and assembled. Additionally, a concrete slab 44 can be poured in a position adjacent to the footings 38 to provide a floor surface for later built portions of the house, such as the living room. The slab surfact is preferably constructed at an elevation level with the support surfaces 40 and 42 of the footings 38 to simplify the construction forms and the pouring of concrete. Advantageously, such an approach also provides a by-level floor design for the finished house, in that the floor system 14 of the modules 10 and 20 or other structures resting on the support surfaces 40 and 42 results in a finished floor surface a step or two above the slab. That is, the thickness of the mud sill, the floor joists, and the flooring on the joists create the step-down effect to the slab. A second slab 46 may be provided and positioned between bordering footings 48 to provide for the construction of a garage attached to the house.

In the third step of the construction process, the modules 10 and 20 are transported from the factory to the building site on the trailer 50 as shown in FIG. 1.

Figure 2:
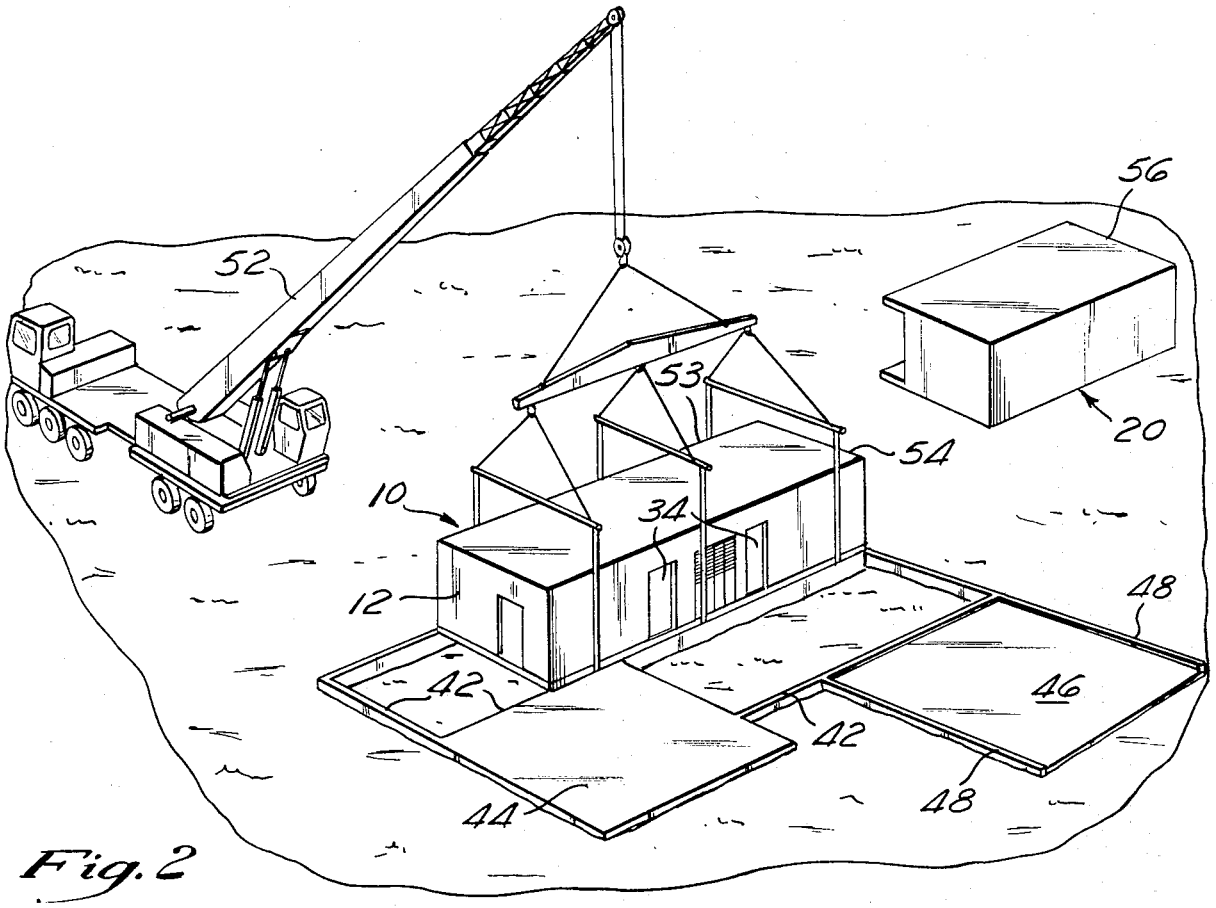

Upon arrival of the module unit at the building site, the modules 10 and 20 are separated by removing the shear panels 21 and the braces, and then cutting the beams that join the modules. Then the module 20 forms a separable component, as shown in phantom lines in FIG. 1. Each module is lifted from its trailer by a crane 52 and positioned upon its mating support surface 40 of the foundation, as shown in FIG. 2. If desired, oversize studs and joists may be employed for additional strength. Thus, wall studs may be 2 by 6 inches and floor joists 2 by 8 or 2 by 10 inches. In this connection, it should be noted that no footings are provided for the interior ends of the modules in that they may be provided with double end joists that span to the footings supporting the sides of the modules.

The modules are preferably positioned with a longer side of one module adjacent to a longer side of the other module, in side-by-side relation, to provide a non-linear modular construction for the first level of the house from the differing lengths of the modules. However, the modular structures may be positioned in varied arrangements to provide for different floor plans for a house.

In FIG. 2, the adjacent walls 53 and 54 of the module 10 form a portion of the exterior of the house. The second module 20 is positioned adjacent to the first module 10 with an end wall 56 in line with the end wall 54 of the first module to continue one of the exterior side walls of the house.

However, the second module may be positioned in varied configurations with respect to the first module to provide for differing floor plans for the first level floor structure of the house, and may or may not provide an exterior wall for the house, as will be later discussed.

It is possible to so position the modules to form exterior side walls because they are constructed according to UBC standards, and will, therefore, uniformly integrate with labor constructed house structure. The walls of the modules constructed according to UBC standards are capable of withstanding all requirements of vertical and horizontal loads.

Once the modules are placed in position on the support surfaces of the foundation 36, they are fastened to the foundation, and to one another, by conventional fastening technique, to provide an integrated conventional structure, constructed to the Uniform Building Code for houses for a substantial portion of the first level of a house. The portions of the first level of a house provided by the modules include those portions which are constructed to standard dimensions. When assembled in position on the support surfaces 40 of the foundation 36, the pair of modules 10 and 20 provide a first level having standard conventional structure of substantially all standard height ceiling portions of this level, and generally defining a base floor level for the house. The ceiling heights are 8 feet, as is typical for conventional house structures. This modular first level section of the house will integrate with labor performed on-site construction according to UBC standards to provide a homogenous house structure.

After the modular structures are fastened into position, in a fourth step, the remaining portions of the house are constructed at the building site by trade workmen, as conventionally accomplished. For example, with reference to FIG. 3, joist floor systems 60 and stud framed walls 62 are constructed for a dining room and for a living room on the remaining adjacent support surfaces of the foundation or around the lower level floor surface provided by the slab 44.

These portions of the house are custom constructed after installation of the modules so that they may advantageously include features of architectural design, such as raised beam ceilings, balconies, and open space within the house. For example, a brick fireplace 64 may be constructed through use of custom construction as can a stone base 66 for a bay window, and other custom constructed features.

Upon completion of on-site construction of step 4, a house of contemporary outward appearance and of conventional construction according to UBC standards for houses is accomplished as depicted in FIG. 4. This method advantageously allows architectural features to be exhibited by the house structure, such as multi-level roof lines 66, exposed brick chimney 70, front bay picture window 72, open entry way 74, dormers 76 and other features of the house which cannot be effectively made in a factory. Through this method, a house can best be built according to conventional techniques using the efficiencies of in-factory construction methods for the standard dimension and standard constructed portions while taking advantage of on-site construction methods for the custon design portions of the house which include architectural design features desirable to the discriminating home buyer. Yet the completed house is completely integrated according to conventional standards, without interface of differing construction styles which can cause structural and inspection problems.

Figure 5:
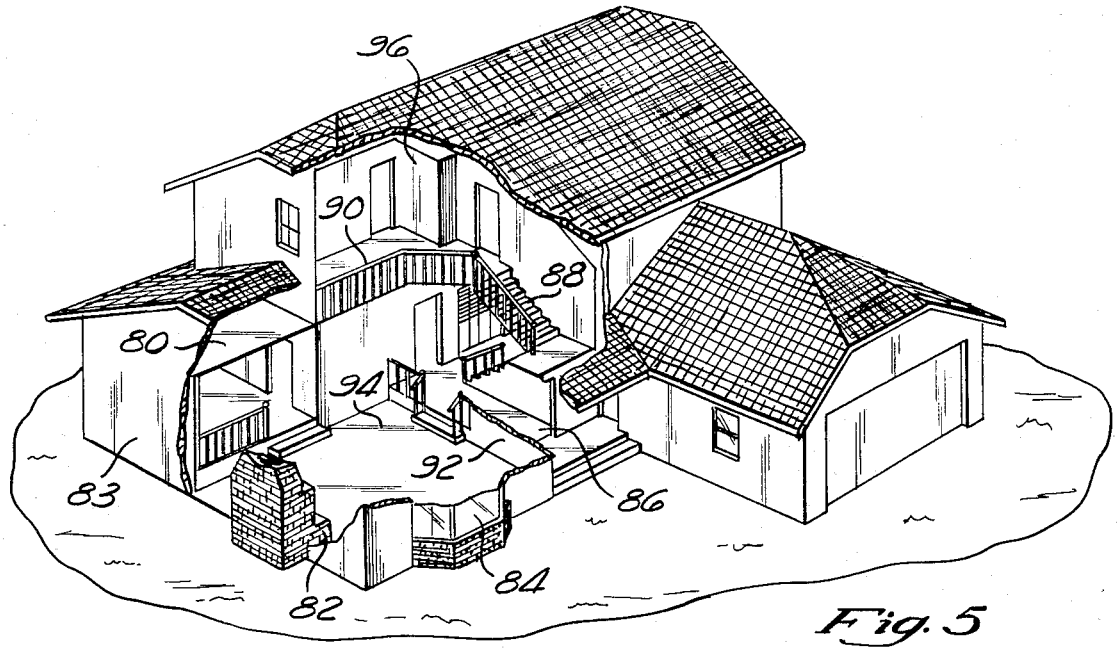

With reference to FIG. 5, the interior of the house can be provided with such features as a beamed cathedral ceiling 80 for the dining and living rooms, an open hearth fireplace 82 custom constructed through an outer wall 83 of the house structure, bay picture window 84, an open entry foyer 86 which has an exposed stairway 88 leading upstairs to an over viewing balcony 90, a tiered entry hall 92 providing entrance to a sunken floor level living room 94.

After the custom designed first level living areas are completed, a second level of rooms 96, sometimes termed a bonus area, may be constructed over the first level of conventional construction techniques and integrated with the first level. These rooms may be custom built and can include similar architectural design features as in the custom constructed first level living areas, including such features as vaulted ceilings, balconies, and dormers. The modules are provided with extending portions of the mechanical and electrical systems, so these systems may be easily extended into the second floor construction if desired. Or these extensory portions may be left in place for finishing of the interior portions of the second level at a later time.

Attachment provisions are made for mechanical and electrical systems, and rolled stores of electrical wiring are provided for easy roll-out.

Figure 7:
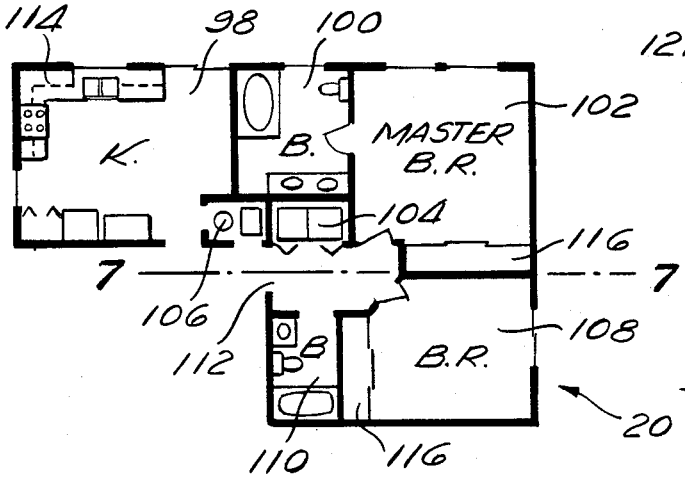
FIG. 7 is a plan view of the modules of FIG. 1.

A preferred floor plan for a pair of factory constructed modular structures is depicted in FIG. 7. The pair of modules are joined along line 7—7 to provide substantially all the standard constructed first level space of a house structure. A first module 10, shown in the upper position, includes a kitchen 93, a bathroom 100, a master bedroom 102, a laundry room 104 and a utility room 106. Each of these rooms is completely finished in the factory and includes substantially all built-in appliances and mechanical and electrical systems for this portion of the house. It also includes interconnections for mechanical and electrical systems between modules when they are placed into position.

A second module 20, shown in the lower position, includes a room 108 which may be used as a bedroom, a family room or a den, and further includes another bathroom 110 opening to a hallway 112. The floor, ceiling and wall structure of the hallway 112 is included in the second module 20. The second module 20 is also provided with all mechanical and electrical systems for this portion of the house and is easily interconnected with the first module through means provided by the factory. The bathrooms 100 and 110 of each module are completely furnished with fixtures and plumbing at the factory to obviate necessity of their installation at the building site. Similarly, cabinetry 114 for the kitchen and closet fixtures 116 for the bedrooms are factory-installed. The interior portions of each of the modules are completely finished except for final decorating, such as painting the interior wall surfaces.

Figure 6:
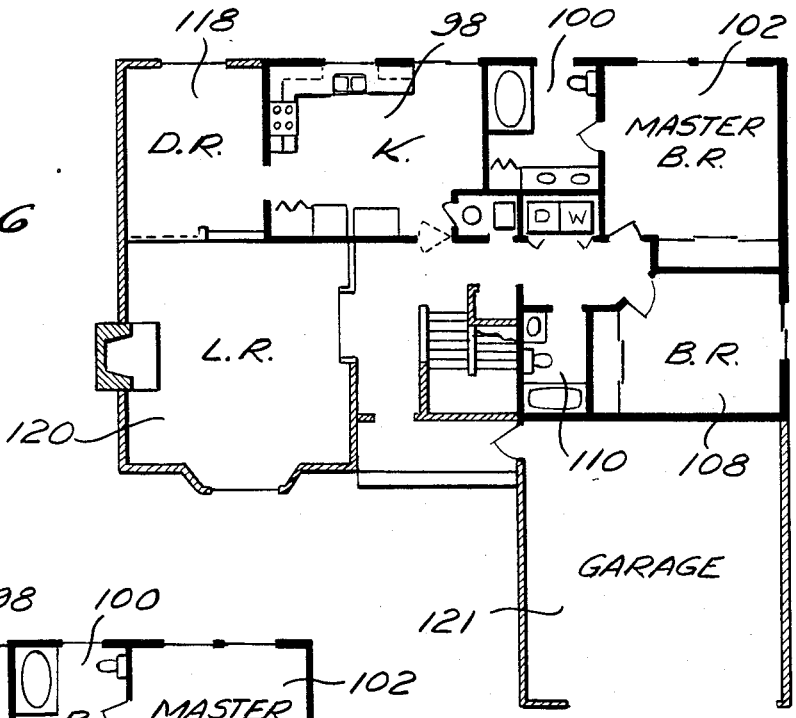
FIG. 6 is a floor plan of the house of FIGS. 1 through 5.

Using factory-built modules allows construction of a multitude of houses having differing floor plans, as is exhibited in FIGS. 6, 8, 10 and 11. In these figures, the modular structures, as combined, are brought forth by the heavy lines in the drawings. FIG. 6 depicts the floor plan of the house described constructed in FIGS. 1 through 5. The floor plan provides a house with seven first story rooms, including the kitchen 98, dining room 118, living room 120, master bedroom 102, additional bedroom 108, and two bathrooms 100 and 110, as well as the entry hall 92, discussed above. A garage 121 is also provided.

FIG. 8 depicts a floor plan for a second story of the house of FIGS. 1 through 5, and FIG. 6, which includes a connecting stairway 123 to the second floor area and a loft or balcony 122 overlooking the entry way 92 and the living room 120. A large closet space 124 is provided adjacent the loft. The bonus area 126 shown in FIG. 8 can be custom constructed to provide future bedrooms or other desired custom constructed areas of the second floor.

FIG. 9 depicts a five room, first floor plan layout of smaller floor area which is constructed through use of the described modular structures, the rooms being indicated by standard symbols.

FIG. 10 depicts a second floor custom constructed area which may be added to the house structure according to the floor plan of FIG. 9. This second story structure includes a stairway 127 connecting to the lower level, a balcony or loft 128 overlooking the dining room 129, and a bonus area 130 which may be custom constructed into bedrooms, or the like.

FIG. 12 depicts an alternative six room floor plan layout of equivalent floor area to that of FIG. 6, though now being of a more square shape than FIG. 6, while using the modular structure pair of this method of construction. FIG. 11 shows a large 8 room floor plan layout which includes an additional first level bedroom or den 132.

Figure 13:
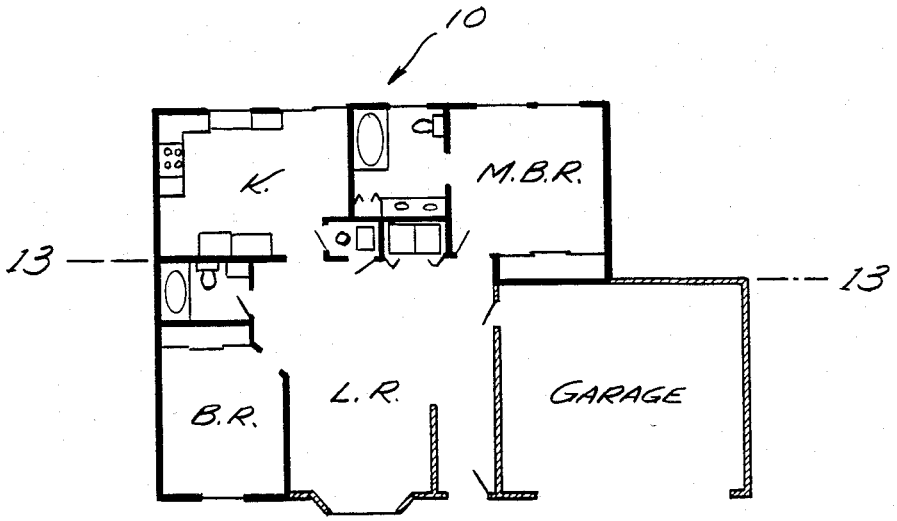

Additionally, alternate floor plan designs are possible by positioning the modular structures in differing arrangemnts from that depicted in FIG. 7. A differing arrangement is exemplified in FIG. 13 where a first module 10 positioned above the line 13—13 is identical with the first module of FIG. 7 above the line 7—7, and a second module 20 positioned below the line 13—13, rotated by 90 degrees and positioned on a different foundation portion, is identical with the modular portion 20 positioned below line 7—7 of FIG. 7. It can be seen the floor plan provides six rooms for a house, yet having a different design than those already described. The interconnections provided in the modular structures are adapted for versatility in module location, to provide optional placements of adjacent modules.

What is claimed is:

1. A method of building a house comprising:

constructing a pair of house modules in a factory, said modules each having a generally rectangular shape and one or more rooms as well as substantially all the mechanical and electrical systems for the house, said modules being constructed in end to end aligned relation with their adjacent end walls being spaced from each other to provide a work area during construction and with structural support means interconnecting the two modules so that they may be shipped as a single unit;

constructing a foundation at a building site for the house including a matrix of footings conventionally constructed in position to provide supporting surfaces for receiving the modules as well as adjacent structures of the house;

transporting the module unit on a single trailer to the building site;

removing or disconnecting the support means interconnecting the two modules so that the modules are separately movable;

moving one of said modules onto the foundation and then moving the second module onto the foundation positioning it in side by side relation with the first module;

fixing the modules to each other; and constructing by conventional techniques the remaining structural portions of the house.

2. The method of claim 1, wherein the combined length of said module unit including the work space between the two modules is no more than can be shipped on a single trailer in accordance with highway safety regulations.

3. A housing construction comprising:

a pair of factory constructed housing modules, each having a generally rectangular shape in one or more rooms, as well as substantially all the mechanical and electrical systems for a house, said modules being positioned in end to end aligned relation with their adjacent end walls being spaced from each other to provide work area during construction of the modules; and structural support means interconnecting the two modules so that they may be shipped as a single unit on a single trailer to a building site wherein the interconnecting means may be removed to permit the modules to be individually moved onto a house foundation.

* * * * *